US009249589B2

(12) United States Patent
Adam

(10) Patent No.: US 9,249,589 B2
(45) Date of Patent: Feb. 2, 2016

(54) COLLECTOR NET AND BRACKET FOR A POOL FILTER

(71) Applicant: Daniel Adam, Ste-Catherine-Jacques-Cartier (CA)

(72) Inventor: Daniel Adam, Ste-Catherine-Jacques-Cartier (CA)

( * ) Notice: Subject to any disclaimer, the term of this patent is extended or adjusted under 35 U.S.C. 154(b) by 211 days.

(21) Appl. No.: 13/972,055

(22) Filed: Aug. 21, 2013

(65) Prior Publication Data

US 2015/0053599 A1 Feb. 26, 2015

(51) Int. Cl.
*E04H 4/12* (2006.01)

(52) U.S. Cl.
CPC ..... *E04H 4/1254* (2013.01)

(58) Field of Classification Search
CPC ..... E04H 4/1254
USPC ..... 210/167.19, 232, 470, 471
See application file for complete search history.

(56) References Cited

U.S. PATENT DOCUMENTS 4,332,683 A * 6/1982 Alt ..... 210/499
6,989,093 B1 * 1/2006 Greathead ..... 210/167.19
7,452,460 B2 * 11/2008 Blake ..... 210/167.19

FOREIGN PATENT DOCUMENTS

WO WO 94/23158 A1 * 10/1994

* cited by examiner

*Primary Examiner* — Fred Prince

(57) ABSTRACT

A collector net having a net section adjustably connected to a bracket section, wherein the bracket section is adapted to adjustably connect to a pool frame. The net section comprising a net member, a net frame attached to the net member, and a handle removably attached to the net frame and adjustably attached to the bracket section. The bracket section has a first bracket member telescopically inserted within a second bracket member, and a threaded nut adapted to hold the first and second bracket members in a desired position and length, wherein the second bracket member includes a pair of legs separated along a length thereof a distance such that the bracket section is adapted to be placed stably upon the pool frame, and a strap member adapted to wrap around the second bracket member and the pool frame to thereby secure the bracket section to the pool frame.

12 Claims, 5 Drawing Sheets

COLLECTOR NET AND BRACKET FOR A POOL FILTER

This application claims priority based on request GB1215110.6 filed Aug. 24, 2012

Collector net and bracket for a pool filter

FIELD OF THE INVENTION

The present invention relates generally to pool accessories but more particularly to a collector net for a pool filter.

BACKGROUND OF THE INVENTION

A filter intake in a swimming pool typically has a screen incorporated therein so as to collect debris so that they do not cause damage to the filter. However, that screen needs to be manually cleaned up from time to time. Especially when there are a lot of leaves and/or wind in the area. When people leave the house for a few days, it is likely that the screen will fill up and block the filter intake.

SUMMARY OF THE INVENTION

In view of the foregoing disadvantages inherent in the known devices now present in the prior art, the present invention, which will be described subsequently in greater detail, is to provide objects and advantages which are:

To provide for a way to eliminate the bulk of debris caught by the screen by providing a catch net in front of the screen.

In order to do so, the invention consists in a collector net apparatus having a net section adjustably connected to a bracket section, wherein the bracket section is adapted to adjustably connect to a pool frame. The net section comprising a net member, a net frame attached to the net member, and a handle member removably attached to the net frame and adjustably attached to the bracket section. The bracket section has a first bracket member telescopically inserted within a second bracket member, and a threaded nut adapted to hold the first and second bracket members in a desired position and length, wherein the second bracket member includes a pair of legs separated along a length thereof a distance such that the bracket section is adapted to be placed stably upon the pool frame, and a strap member adapted to wrap around the second bracket member and the pool frame to thereby secure the bracket section to the pool frame, and thereby secure and hold the net section in place with respect to the pool frame and pool filter system.

The collector net apparatus has the bracket section include a threaded bolt and wing nut placed through a distal end section of the first bracket member that is distal from the second bracket member, and the handle member of the net section is formed having an elongated space along a length thereof, such that the threaded bolt and wing nut can be placed through the elongated space of the handle member and tightened and secured to a chosen portion along the elongated length, thereby adapted to adjust and secure the height of the net section with respect to the pool frame.

The collector net apparatus has a first of the pair of legs of the second bracket member securely attached thereto, and a second of the pair of legs connected to a movable leg bracket that is formed to fit around and slide along a length of the second bracket member; wherein the movable leg bracket includes a threaded nut that passes therethrough and contacts the second bracket member, such that the distance between the first and second legs can be adjusted and secured to thereby adapt to a variety of pool frame shapes and sizes.

The collector net apparatus has the net frame attached to a substantial portion of the edges of the net member.

The net member is formed having an internal volume in the shape of a rectangular volume, and the bracket member has a cross-section formed in the shape of a rectangle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1A:
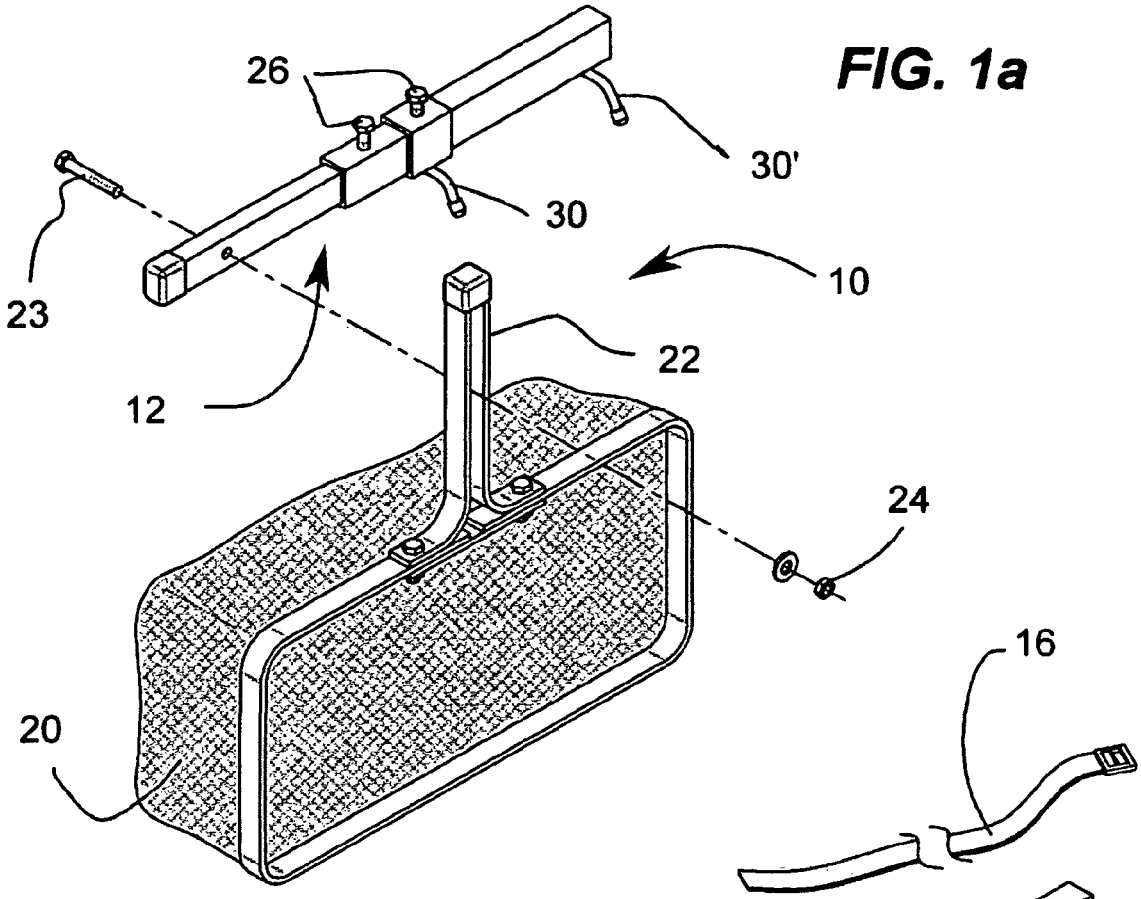
FIGS. 1*a-b* Isometric views of the invention.
Figure 1B:
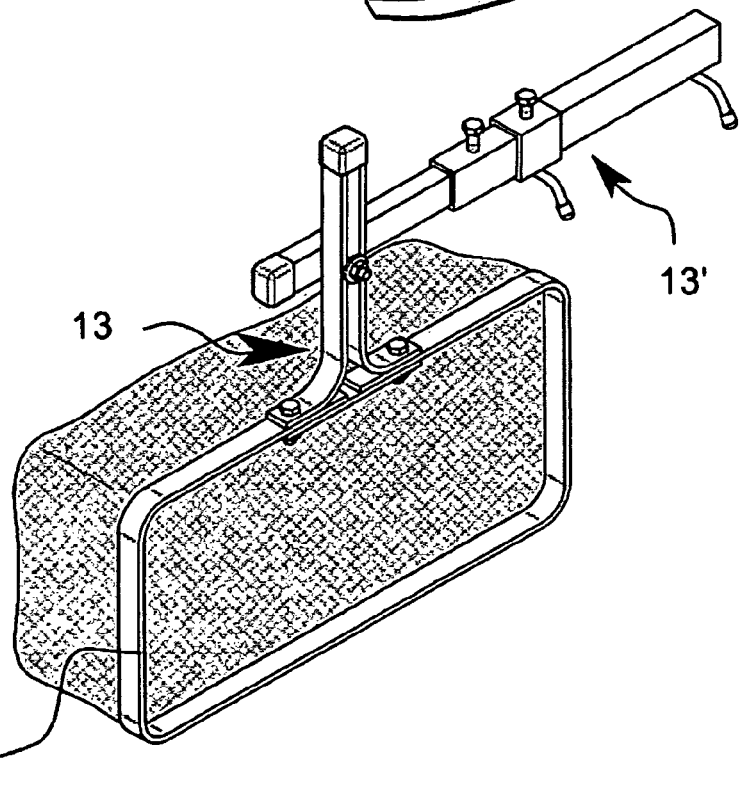
Figures 2A, 2B:
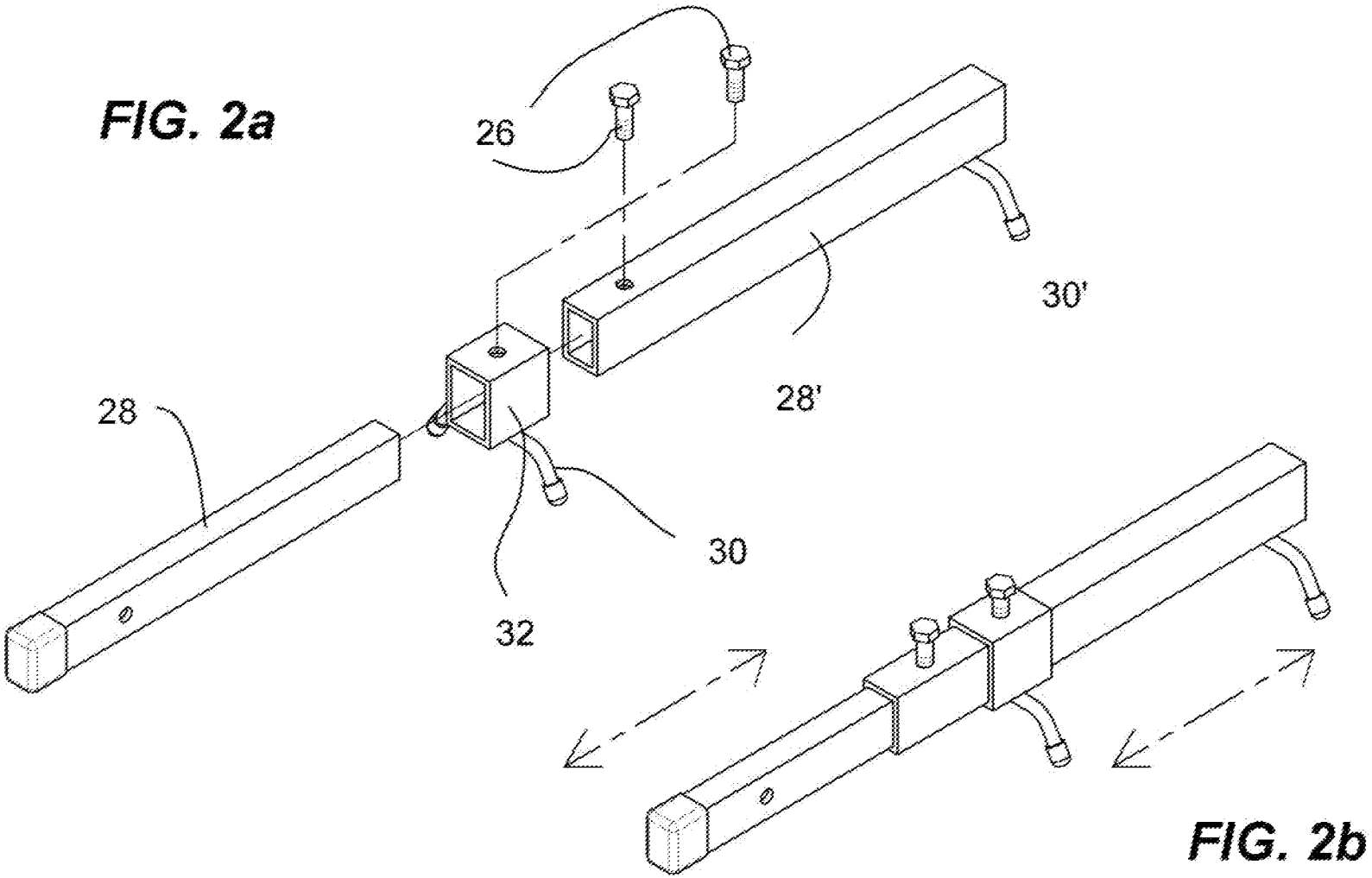
FIGS. 2*a-b* Isometric views of the bracket member.
Figures 3A, 3B:
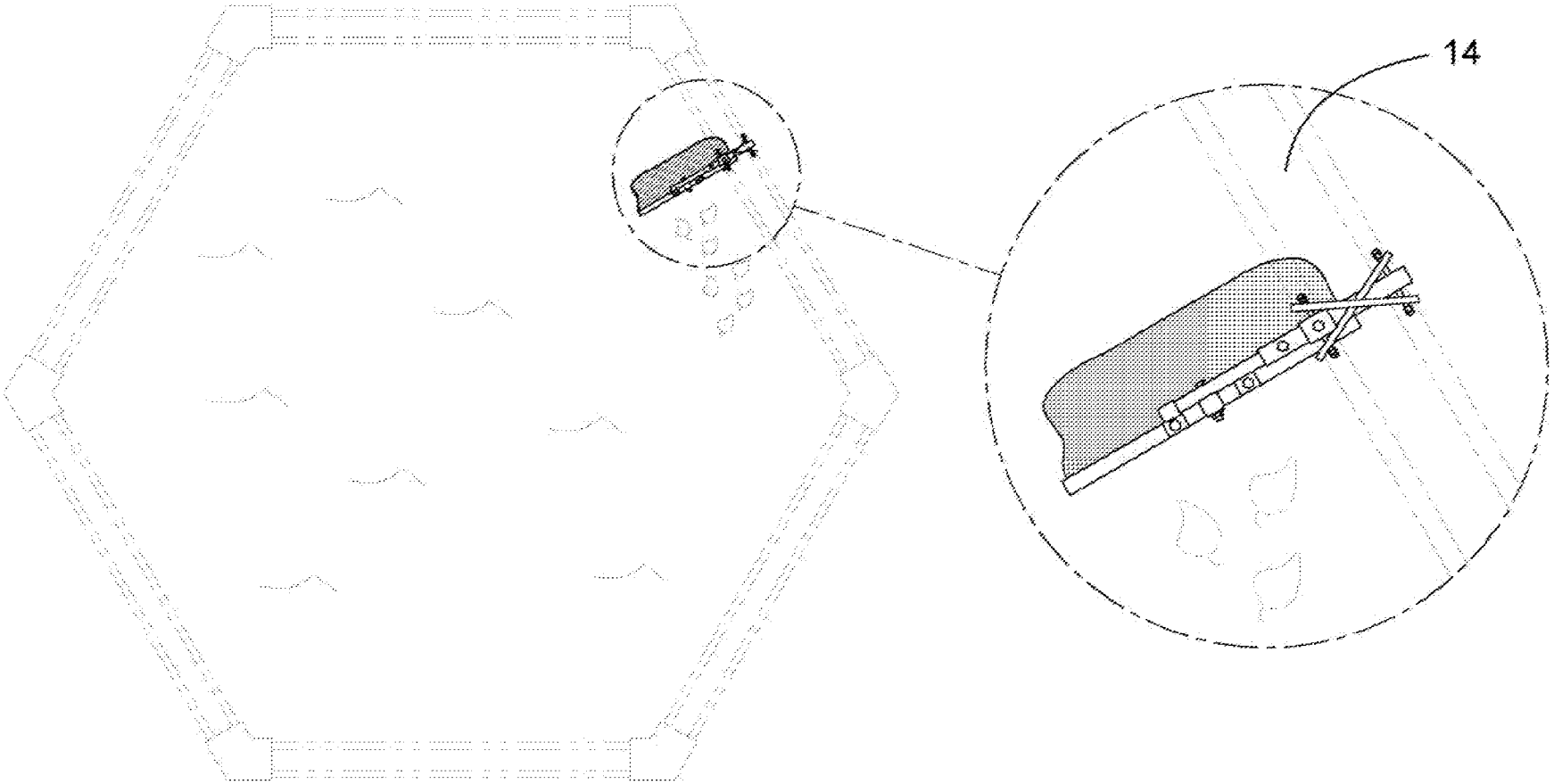
FIGS. 3*a-b* Top view and top view detail of the invention in context.
Figure 4A:
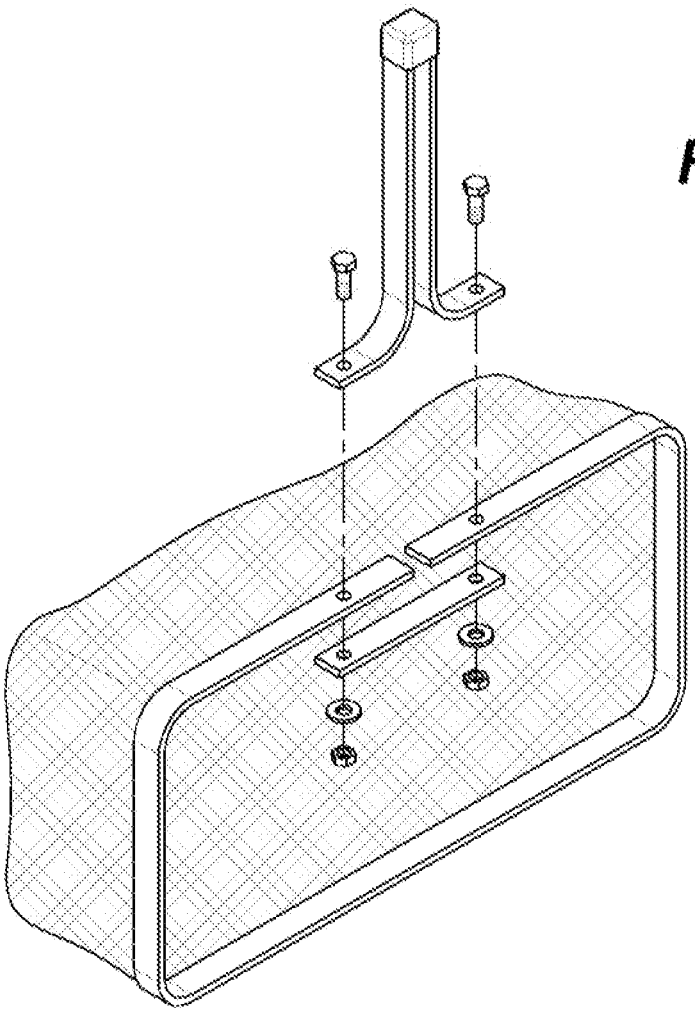
FIGS. 4*a-b* Isometric views of the net and frame.
Figure 4B:
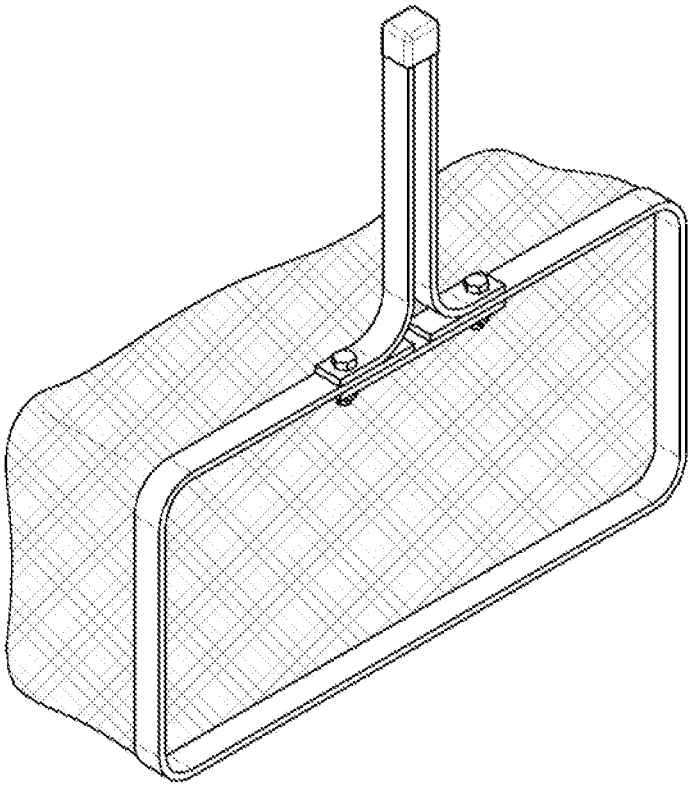
Figure 5:
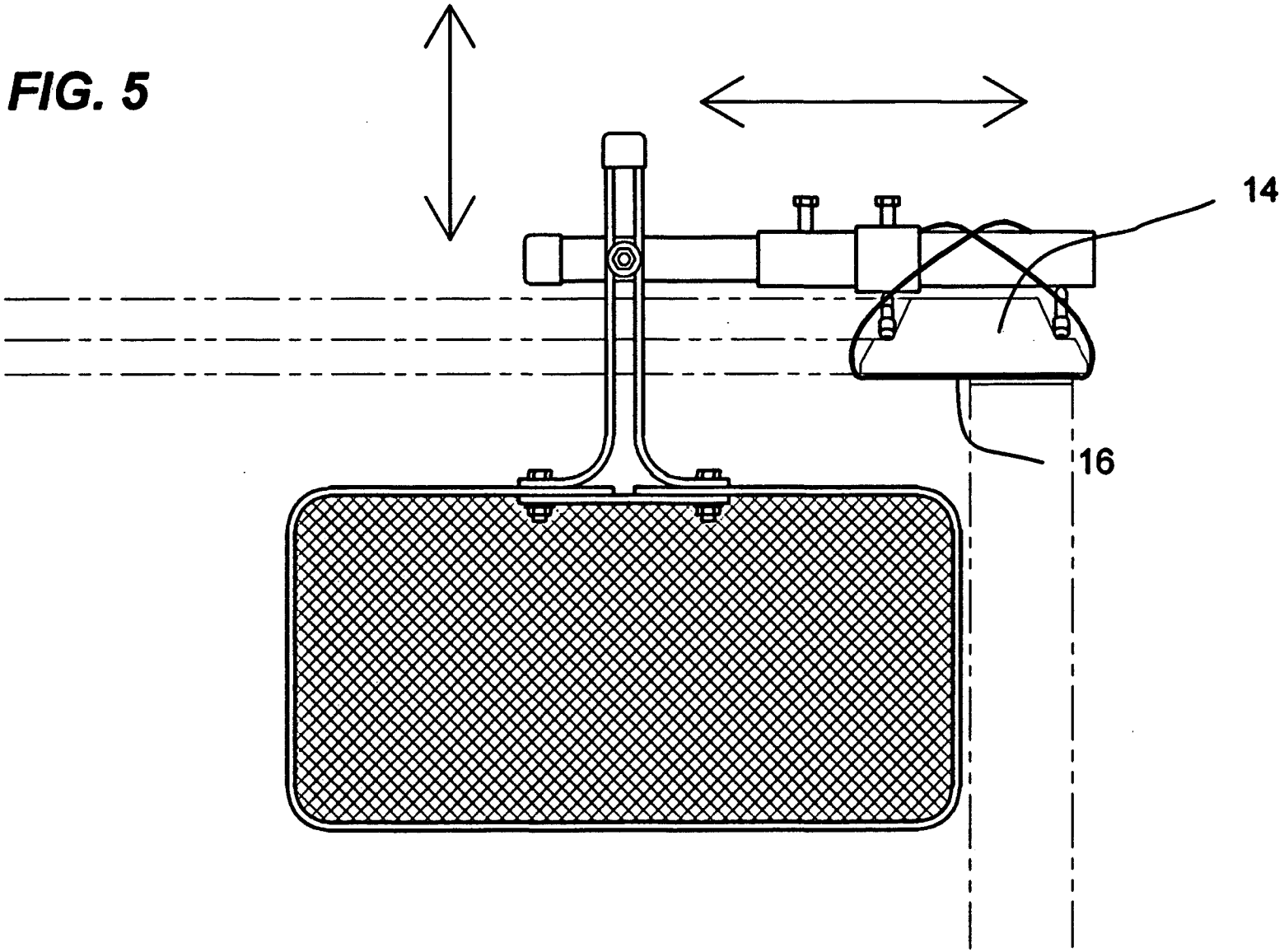
FIG. 5 Front view of the invention in context.

A collector net and bracket (10) for a pool filter (not shown) has a telescopic bracket member (12) having a first and a second section (13, 13') attached to a pool frame (14) by way of a strap (16). The bracket member (12) connects to a net frame (18) which holds a net section (20), by way of a handle member (22). The height of the net section (20) can be adjusted by way of a threaded bolt (23) and wing nut (24) used for tightening the handle member (22) to the bracket member (12).

The telescopic bracket member (12) adjusts the distance of the net frame (18) to the pool frame (14). A threaded nut (26) locks the telescoping sections (28, 28') in a given configuration.

The bracket section (12) has two pairs of legs (30,30') so as to steady the bracket section (12) onto the pool frame (14), The strap (16) then attaches the bracket section (12). Because pool frames (14) have different width, one of the two pairs of legs (30) is attached to a movable leg bracket (32) which slides along the telescoping section (28') and is locked in place by a threaded nut (26).

In use, the collector net and bracket (10) is simply installed as described hereinabove and placed proximal the pool filter so that the water movement inside the pool naturally draws floating debris towards the filter and thus into the net section (20). Because the process is automatic, there is no need for anyone to operate the device, except for removing the debris from time to time.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A collector net apparatus for a pool filter system, said collector net apparatus comprising a net section adjustably connected to a bracket section, wherein said bracket section is adapted to adjustably connect to a pool frame; said net section comprising a net member, a net frame attached to said net member, and a handle member removably attached to said net frame and adjustably attached to said bracket section; said bracket section comprising a first bracket member telescopically inserted within a second bracket member, and a threaded nut adapted to hold said first and second bracket members in a desired position and length, wherein said second bracket member includes a pair of legs separated along a length thereof a distance such that said bracket section is adapted to be placed stably upon said pool frame; and a strap member adapted to wrap around said second bracket member and said pool frame to thereby secure said bracket section to said pool frame, and thereby secure and hold said net section in place with respect to said pool frame and pool filter system.

2. The collector net apparatus of claim 1, wherein said bracket section includes a threaded bolt and wing nut placed through a distal end section of said first bracket member that is distal from said second bracket member; and said handle member of said net section is formed having an elongated space along a length thereof, such that said threaded bolt and wing nut can be placed through said elongated space of said handle member and tightened and secured to a chosen portion along said elongated length, thereby adapted to adjust and secure the height of said net section with respect to said pool frame.

3. The collector net apparatus of claim 1, wherein a first of said pair of legs of said second bracket member is securely attached thereto, and a second of said pair of legs is connected to a movable leg bracket that is formed to fit around and slide along a length of said second bracket member; wherein said movable leg bracket includes a threaded nut that passes therethrough and contacts said second bracket member, such that the distance between said first and second legs can be adjusted and secured to thereby adapt to a variety of pool frame shapes and sizes.

4. The collector net apparatus of claim 1, wherein said net frame attaches to a substantial portion of the edges of said net member.

5. The collector net apparatus of claim 1, wherein said net member is formed having an internal volume in the shape of a rectangular volume.

6. The collector net apparatus of claim 1, wherein said bracket member has a cross-section formed in the shape of a rectangle.

7. A pool filter system for filtering the water of a swimming pool, said pool filter system comprising a pool filter adapted to be placed at a chosen location within said swimming pool; and a collector net apparatus adapted to be placed proximal said pool filter, such that water movement within said swimming pool will draw floating debris towards said pool filter and into said collector net before reaching said pool filter; wherein said collector net apparatus comprises a net section adjustably connected to a bracket section, wherein said bracket section is adapted to adjustably connect to a pool frame; said net section comprising a net member, a net frame attached to said net member, and a handle member removably attached to said net frame and adjustably attached to said bracket section; said bracket section comprising a first bracket member telescopically inserted within a second bracket member, and a threaded nut adapted to hold said first and second bracket members in a desired position and length, wherein said second bracket member includes a pair of legs separated along a length thereof a distance such that said bracket section is adapted to be placed stably upon said pool frame; and a strap member adapted to wrap around said second bracket member and said pool frame to thereby secure said bracket section to said pool frame, and thereby secure and hold said net section in place with respect to said pool frame and pool filter system.

8. The pool filter system of claim 7, wherein said bracket section includes a threaded bolt and wing nut placed through a distal end section of said first bracket member that is distal from said second bracket member; and said handle member of said net section is formed having an elongated space along a length thereof, such that said threaded bolt and wing nut can be placed through said elongated space of said handle member and tightened and secured to a chosen portion along said elongated length, thereby adapted to adjust and secure the height of said net section with respect to said pool frame.

9. The pool filter system of claim 7, wherein a first of said pair of legs of said second bracket member is securely attached thereto, and a second of said pair of legs is connected to an movable leg bracket that is formed to fit around and slide along a length of said second bracket member; wherein said movable leg bracket includes a threaded nut that passes therethrough and contacts said second bracket member, such that the distance between said first and second legs can be adjusted and secured to thereby adapt to a variety of pool frame shapes and sizes.

10. The pool filter system of claim 7, wherein said net frame attaches to a substantial portion of the edges of said net member.

11. The pool filter system of claim 7, wherein said net member is formed having an internal volume in the shape of a rectangular volume.

12. The pool filter system of claim 7, wherein said bracket member has a cross-section formed in the shape of a rectangle.

* * * * *